US007478721B2

(12) United States Patent
Herd

(10) Patent No.: US 7,478,721 B2
(45) Date of Patent: Jan. 20, 2009

(54) DEVICE FOR CONVEYING SHEET-TYPE FLAT ITEMS

(75) Inventor: Nicolas Herd, Nurtingen (DE)

(73) Assignee: Kugler-Womako GmbH, Nuertingen (DE)

( * ) Notice: Subject to any disclaimer, the term of this patent is extended or adjusted under 35 U.S.C. 154(b) by 94 days.

(21) Appl. No.: 11/785,824

(22) Filed: Apr. 20, 2007

(65) Prior Publication Data

US 2007/0246881 A1 Oct. 25, 2007

(30) Foreign Application Priority Data

Apr. 20, 2006 (DE) ..... 10 2006 018 769

(51) Int. Cl.
*B65H 5/34* (2006.01)

(52) U.S. Cl. ..... 198/626.5; 271/273; 271/277; 271/206

(58) Field of Classification Search ..... 198/626.3, 198/626.5; 271/273, 277, 206
See application file for complete search history.

(56) References Cited

U.S. PATENT DOCUMENTS 4,285,513 A * 8/1981 Kwasnitza ..... 271/270
4,385,537 A * 5/1983 Wolf ..... 83/100
4,973,039 A * 11/1990 Jeske et al. ..... 271/151
5,265,861 A * 11/1993 Schaffner et al. ..... 271/182
6,591,722 B1 * 7/2003 Sauer ..... 83/107
6,673,005 B2 * 1/2004 Blanchard ..... 493/460
2008/0073837 A1 * 3/2008 DeGruchy ..... 271/273

* cited by examiner

*Primary Examiner*—Mark A Deuble
(74) *Attorney, Agent, or Firm*—Robert Kinberg; Venable LLP

(57) ABSTRACT

A feed conveyor feeds in flat items to a discharge conveyor that discharges the same. A joint upper belt conveyor extends across feed-in and discharge regions and has a lower belt section above the feed and discharge conveyors. An operating mechanism moves a lower belt section of the joint upper belt conveyor between: a first position in which a gap is formed between the lower belt section of the joint upper belt conveyor and the discharge conveyor that prevents the joint upper belt conveyor from making contact with the flat items on the discharge conveyor; and a second position in which the gap between the lower belt section of the joint upper belt conveyor and the discharge conveyor is such that the top of the flat item makes contact with the upper join conveyor belt.

13 Claims, 2 Drawing Sheets

DEVICE FOR CONVEYING SHEET-TYPE FLAT ITEMS

CROSS-REFERENCE TO RELATED APPLICATION

This application claims the priority of German Patent Application No. 10 2006 018 769.5-27, filed on Apr. 20, 2006, the subject matter of which is incorporated herein by reference, together with the disclosures of each U.S. and foreign patent and patent application mentioned below.

BACKGROUND OF THE INVENTION

The invention relates to a device for conveying sheet-type, flat items that preferably consist of a flexible material, in particular sheets of paper, the device comprising a feed-in region provided with a lower feed conveyor for conveying and successively feeding in the flat items, a discharge region that follows the feed-in region in a downstream direction and is provided with a lower discharge conveyor for discharging the flat items, a joint upper belt conveyor that extends across the feed-in region as well as the discharge region and has a lower belt section, arranged above the lower feed conveyor, to allow the top of a flat item positioned on the lower feed conveyor to make contact with the joint upper belt conveyor, as well as an overlap device for generating an overlapping flow of flat items in the discharge region.

German Patent document DE 27 25 547 A1 discloses a device installed downstream of a cross-cutter, which is used to form an overlapping flow of flat items such as sheets or magazines. This known device comprises fast-moving upper belts, jointly guided across a feed-in region as well as a discharge region, fast-moving lower belts in the feed-in region and downstream arranged slow-moving lower belts in the discharge region, wherein the slow-moving lower belts in the discharge region act as deceleration belts and generate the overlapping flow. The fast-moving upper belts with their lower belt sections in the discharge region can be adjusted slightly in height by eccentrically positioned rollers to correspondingly adjust the distance to the slow-moving lower belts, so as to adapt to the thickness of the overlapping flow to be generated. This known device is furthermore provided with an overlap finger and a downstream arranged suction box, which can be adjusted either in the conveying direction or counter to the conveying direction. A braking roll is arranged on the upper side, downstream of the suction box, and is provided with an associated support roller that is positioned on the lower side.

German patent document DE 14 61 244 A1 discloses a device, installed downstream of a cross cutter, for slowing down paper sheets or the like in order to generate an overlapping flow. This known device comprises fast-moving upper belts that are followed downstream by slow-moving upper belts, and fast-moving lower belts that are followed downstream by slow-moving lower belts, which function as deceleration belts. Furthermore provided is an overlap finger with a braking roll or a deceleration belt. A free-wheeling contact roller is arranged downstream of the overlap finger.

German patent document DE 29 39 377 A1 discloses a device, following downstream of a cross cutter, for slowing down and overlapping paper sheets. This device is provided with fast-moving upper belts that extend across a feed-in region as well as a discharge region, and fast-moving lower belts in the feed-in region that are followed in the discharge region by downstream arranged slow-moving lower belts, functioning as braking belts. Furthermore provided are an overlap finger and a following braking roll. The braking roll has a flattened section to prevent pressure from being applied to the leading edges of the paper sheets, which are already arranged overlapped and thus scaled at this location.

German patent document DE 31 18 746 A1 describes a device installed downstream of a cross cutter for picking up and conveying sheets having an undesirable pre-bending. This known device is provided with upper and lower belts, which can be adjusted in the conveying direction and counter to the conveying direction. In addition, the intake angle between upper and lower belts can also be adjusted.

German patent document DE 39 40 960 A1 discloses a device installed downstream of a cross cutter for slowing down sheets to be deposited in a stack, in particular sheets of paper or cardboard. This known device is provided with a group of accelerating upper belts and lower belts, as well as a downstream installed pair of braking rolls. The braking rolls have a profile that allows for a continuous deceleration of the sheets. This known device is designed to generate an overlapping flow shortly before the stack front is reached, wherein this overlapping flow is generated according to a first example with the aid of a suction box and according to a second example directly with the aid of the pair of braking rolls.

German patent document DE 199 45 114 A1 and the associated European patent document EP 1 214 264 A1 describe respectively a device, installed downstream of a cross cutter, for generating an overlapping flow. This known device is provided with a transfer-out device, accelerating upper and lower belts, as well as a suction box with a downstream-positioned lower belt that functions as a braking belt. The distance between the upper belts and the conveying plane can be adjusted to adapt to the thickness of the overlapping flow to be generated. The upper and lower belts can furthermore be adjusted in a conveying direction and counter to the conveying direction for the purpose of a format adjustment. The transfer-out device is furthermore embodied so as to pivot for removing a jam.

German patent document DE 20 2004 005 827 A1 and the corresponding PCT publication WO 05/097647 A1 respectively disclose a device that is installed downstream of a cross cutter and is designed to generate an overlapping flow. This known device comprises a transfer-out device, accelerating upper and lower belts, as well as a suction box with downstream arranged braking belts. Pivoting braking rolls are arranged above the braking belts, such that they can act by an adjustable spring force onto the sheets, which are already overlapped at this location.

When generating an overlapping flow with the aid of the above-described devices, the processing speed inside the machine can be increased considerably, not least because the impact energy is noticeably lower when entering the stacking region.

However, generating an overlapping flow is not advisable for papers with extremely sensitive surfaces because of the high danger of damage caused by the overlapping. In particular items belonging to the product spectrum of paper sheets with a shiny surface, such as photographic paper, cannot tolerate overlapping because the cut edge as well as the backside of the overlapping section of the paper sheet can leave interfering marks or flaws on the shiny surface.

SUMMARY

It is therefore an object of the present invention to modify and improve a device of the aforementioned type so that the process can be adapted easily and within a short time, in dependence on the characteristics of the flat items to be processed.

The above and other objects are achieved according to the invention, wherein there is provide in one embodiment, an apparatus for conveying sheet-type, flat items, comprising: a lower feed-in conveyor in a feed-in region to convey and successively feed in the flat items in a conveying direction; a lower discharge conveyor in a discharge region, following the feed-in region in the conveying direction, and having an upper belt section to convey and discharge the flat items; a joint upper belt conveyor extending across the feed-in region and the discharge region and having a lower belt section which is positioned above the lower feed-in conveyor such that a top of a flat item positioned on the lower feed-in conveyor comes in contact with the joint upper belt conveyor; an overlap device to generate an overlapping flow of flat items in the discharge region, the overlap device having first and second operating states; a control unit for switching the overlap device between the first and a second operating states, wherein the control unit activates the overlap device in the first operating state and deactivates the overlap device in the second operating state; and a first operating mechanism connected to the control unit and operative to move the lower belt section of the joint upper belt conveyor that faces the lower discharge conveyor between (i) a first position in the first operating state to form a gap between the lower belt section of the joint upper belt conveyor and the upper belt section of the lower discharge conveyor to prevent the joint upper belt conveyor from making contact with the flat items positioned on the lower discharge conveyor, and (ii) a second position in the second operating state to form a gap between the lower belt section of the joint upper belt conveyor and the upper belt section of the lower discharge conveyor, so that only a single flat item can respectively be introduced between the lower discharge conveyor and the joint upper belt conveyor, wherein the underside of the flat item rests on the lower discharge conveyor and the top makes contact with the joint upper belt conveyor.

The advantage of the device according to the embodiment is that the process and thus also the machine can be adapted easily and within a short time, in dependence on the characteristics and particularly the sensitivity of the flat items to be processed. The configuration according the invention thus for the first time allows switching between an overlapping operation in a first operating state and a non-overlapping operation in a second operating state within the same device or machine. The switching can be realized within a short time, thereby preventing a noticeable interruption in the process during a material change for the flat items to be processed. A second machine, requiring a time-consuming setup and resulting in further costs is therefore not needed. The invention makes it possible to process flat items with very different characteristics on one and the same machine and takes into consideration the processing of sensitive paper sheets by switching the device to the non-overlapping operation in the second operating state. For the processing of less sensitive flat items, the production is again switched to the overlapping operation in the first operating state, which results in a manifold increase in the production.

For the non-overlapping operation in the second operating state, the lower belt section of the joint upper belt conveyor is lowered with the aid of the first operating mechanism, controlled by the control unit, and/or the upper belt section of the lower discharge conveyor is raised to ensure a frictionally adhering, controlled guidance of the flat items at continued high speed during the discharge from the discharge region. With this type of configuration, the switch to the overlapping operation in the first operating state only requires raising the lower belt section of the joint upper belt conveyor and/or lowering the upper belt section of the lower discharge conveyor, so that the lower belt section of the joint upper belt conveyor can no longer influence the conveying of the flat items. In the process, the joint upper belt conveyor continues to operate at the same high speed. A corresponding reversal of the conveying speed of the joint upper belt conveyor is thus not necessary and is not even desired since the joint upper belt conveyor must continue to exert and thus maintain its conveying influence in the feed-in region on the flat items arriving at high speeds. The lowering and raising according to the invention of the lower belt section for the joint upper belt conveyor in the discharge region and/or of the upper belt section of the lower discharge conveyor represents a structurally simple and uncomplicated measure for switching within an extremely short time between an overlapping and a non-overlapping operation, together with a simultaneous activation or deactivation of the overlap device, thereby making it very effective with respect to time.

To be sure, documents DE 27 25 547 A1 and DE 199 45 114 A1, as well as the corresponding EP 1 214 264 A1, essentially teach a vertical adjustment of the upper belts. However, such an adjustment of the upper belts is used exclusively for adjusting the distance to the conveying plane and/or the upper belt section of the lower belts, positioned underneath, so as to adapt to the thickness of the generated overlapping flow, while the upper belts remain in contact with the overlapping flow, regardless of the height adjustment. This in particular is not the object of the present invention. Rather, with the design according to the invention, raising the joint upper belt conveyor causes the conveyor to completely loose contact with the flat items positioned on the lower discharge conveyor, thereby completely removing its influence on the conveyed flow. A quick and uncomplicated switch from the non-overlapping operation in the second operating state to an overlapping operation in the first operating state is therefore possible only with the measure according to our invention. A combination operation of this type cannot be realized with the known devices and is not even addressed in the prior art. Otherwise, a displacement of the upper belts is not even planned for the devices described in the previously discussed documents.

In an especially preferred embodiment of the invention, there is provided a second operating mechanism, which is connected to the control unit and is used to displace the end of an upper belt section of the lower feed conveyor, arranged adjacent to the discharge region and carrying the flat items, and/or the beginning of the upper belt section adjacent to the feed-in region of the lower delivery conveyor, between a first position in the first operating state where for the purpose of generating an overlap stage, the end of the upper belt section of the lower feed conveyor is positioned higher than the beginning of the upper belt section for the lower discharge conveyor adjacent to the feed-in region, and a second position in the second operating state where the end of the upper belt section of the lower feed conveyor that is adjacent to the discharge region is substantially at the same height as the beginning of the upper belt section of the delivery conveyor that is adjacent to the feed-in region. Forming such an overlapping or drop stage is particularly advantageous for effectively obtaining an overlapping flow of format-trimmed, flat items for the overlapping operation in the first operating state, in connection with the overlap device and possibly a downstream-connected braking device such as a braking roll. In contrast, an overlap stage of this type is not necessary for the non-overlapping operation in the second operating state and is even undesirable in some cases because it may prevent a smooth, non-overlapping operation. It is therefore advantageous to form an overlap stage during the overlapping operation in the first operating state, but to level this overlap stage again for the non-overlapping operation in the second operating state.

Insofar as a deflection device is provided, preferably there is provided at least one deflection roller that deflects the upper belt section of the lower feed conveyor at the end adjacent to the discharge region. As is usually the case, this deflection device should advantageously be positioned such that it can be moved between a first position and a second position and can be activated by means of the second operating mechanism for the movement between the first and the second position. A structurally simple embodiment is distinguished in that the deflection device is positioned on a swivel lever that can be swiveled with the aid of the second operating mechanism, for example a pneumatic piston-cylinder device.

According to another embodiment, there is provided a first deflection device in the discharge region, preferably having at least a first roller, for deflecting the lower belt section of the joint upper belt conveyor, such that it moves away from the lower discharge conveyor. This lower belt section of the joint upper belt conveyor therefore never makes contact with the flat items positioned on the lower discharge conveyor. This embodiment is distinguished in that the deflection device is positioned so as to move between a lower position and an upper position and can be activated by the first operating mechanism for moving between the upper and lower position, thereby offering a structurally simple and simultaneously effective option for lowering and raising the lower belt section of the joint upper belt conveyor.

If a second deflection device, preferably in the form of at least one roller, is provided in the discharge region, for deflecting the lower belt section of the joint upper belt conveyor that has already been deflected by the first deflection device approximately in the conveying direction, but at a distance to the lower discharge conveyor, a support is advantageously provided for jointly mounting the first and the second deflection devices. This support should be positioned so as to be movable between a lower position and an upper position, wherein the support is activated by the first operating mechanism for a movement between the lower and the upper positions.

In another embodiment, a discharge region is provided with an upper discharge conveyor that is arranged above the lower discharge conveyor, and there is provided a third operating mechanism for adjusting the spacing between the lower belt section of the upper discharge conveyor, preferably its beginning section, and the upper belt section of the lower discharge conveyor. This third operating mechanism, which can optionally be operated manually or with a motorized drive, is used in particular for correspondingly adjusting the gap between the upper discharge conveyor and the lower discharge conveyor during the overlapping operation in the first operating state, in dependence on the thickness of the overlapping flow to be generated. Insofar as a deflection device is provided, preferably in the form of at least one roller, for deflecting the beginning of the lower, belt section of the upper discharge conveyor, this deflection device is position so that its distance to the upper belt section of the lower discharge conveyor can be adjusted with the aid of the third operating mechanism. A device of this type has the advantage that the lower belt section of the joint upper belt conveyor can be lowered and raised without problem and without affecting the belt tensioning.

The upper discharge conveyor should preferably be installed downstream of the effective range for the joint upper belt conveyor, which is delimited by the device for deflecting the lower belt section of the joint upper belt conveyor.

The overlap device may advantageously comprise at least one rotatable overlap finger arranged in the discharge region, adjacent to the feed-in region and driven to rotate with the same timing as the arriving flat items, such that it pushes down the trailing edge of a flat item as it moves past. In the second operating state, the control unit advantageously removes the overlap finger from the flat items and maintains it in a position where it remains out of contact with the flat items.

Finally, the control unit may advantageously be connected to drives for the belt conveyors and should control these in the first operating state, such that the joint upper belt conveyor and the lower feed conveyor respectively are driven with a first speed and the belt conveyor(s) for the discharge region is (are) driven with a second speed that is lower than the first speed. In the second operating state, the drives should be controlled such that all belt conveyors are essentially driven with the same speed. Since a fast upper belt conveyor in the overlapping operation during the first operating state cannot act upon the conveyed goods, the speed of the joint upper belt conveyor does not need to be reduced to the second speed. For the sake of completeness, the control unit can comprise separate controls for the individual drives.

In another embodiment, at least one braking roll is positioned rotating in the discharge region, downstream of the overlap device, and above the upper belt section of the lower discharge conveyor, such that the tops of the flat items positioned on the lower discharge conveyor come in contact with the braking roll. If a drive is used for operating the at least one braking roll, then the control unit may also be connected to the drive for the at least one braking roll. In that case, the control unit may control the braking roll so that in the first operating state and in the second operating state, the at least one braking roll rotates approximately synchronously with the lower discharge conveyor. As a result, the at least one braking roll can have a braking effect during the overlapping operation in the first operating state, but does not exert a braking force during the operation in the second, non-overlapping operating state and cannot interfere with a fast conveying of individual items.

Within the meaning of the present invention, the term "belt conveyor" optionally refers to a single conveying belt of optional width or a group of jointly driven conveying belts that are arranged substantially parallel to each other, have essentially the same length, and optionally have the same or different widths, wherein the conveying belt or the conveying belts is (are) generally embodied as continuously circulating conveying belt(s).

BRIEF DESCRIPTION OF THE DRAWINGS

These and other features and advantages of the invention will be further understood from the following detailed description with reference to the accompanying drawings.

DETAILED DESCRIPTION

The device shown in the Figures depicts a portion of a paper processing plant, which is not shown completely herein, in which a paper web (among other things) is supplied with the aid of conveying belts to a cross cutter, also not shown herein, and is cut by the cross cutter into individual sheets of a desired length. The separate sheets are then conveyed by the device shown in the Figures to a location of deposit, also not shown herein, where they are stacked one above the other.

For the sake of completeness and for reasons of simplicity, the belt conveyors are illustrated in the Figures as a single conveying belt and are also referred to as such in the following description. However, the device can alternatively also comprise a group of jointly driven and parallel arranged conveying belts. The conveying belts shown herein and described in the following are continuously rotating belts, which are driven by individual drives that are not shown herein.

The device shown in the Figures can be divided into a feed-in region I and a discharge region II, which follows the feed-in region I in downstream direction, wherein the paper sheets that are not shown individually are conveyed in the direction of arrow A in the Figures, meaning from the left to the right. The conveying path in the Figures extends in the plane for arrow A.

Figure 1:
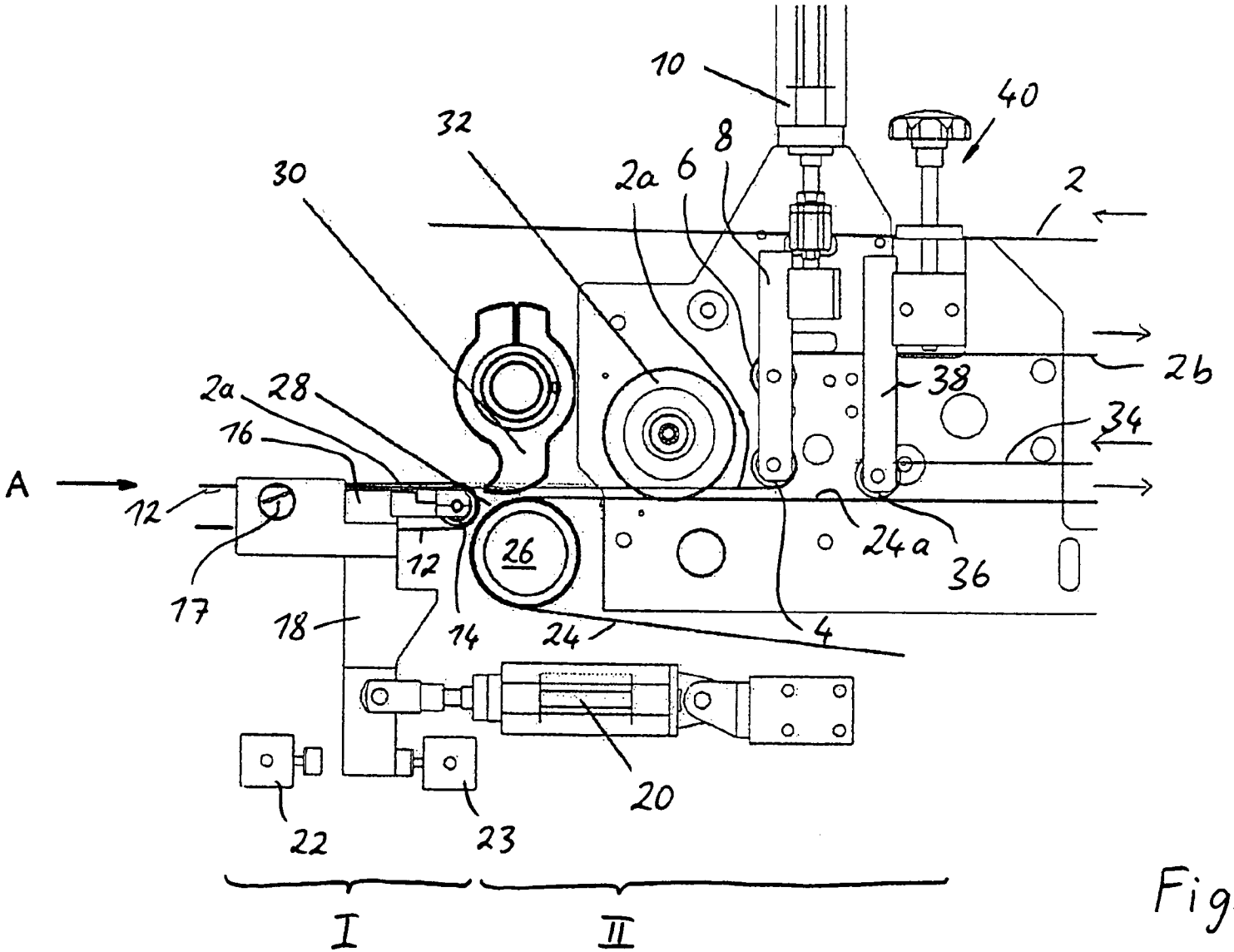
FIG. 1 is a schematic view from the side of an embodiment of the device according to the invention, depicting a first operating state for the overlapping operation.

The device comprises a joint upper belt 2, of which the lower belt section 2*a* moves in the feed-in region I as well as in the discharge region II in conveying direction A. In the discharge region II, the joint upper belt 2 is deflected upward by a first deflection roller 4, from its lower belt section 2*a*, and is then deflected by a second deflection roller 6, arranged above the first one, in a direction parallel to the conveying direction A where the joint upper belt 2 with its belt section 2*b* is now guided clearly at a distance above the conveying track. The first deflection roller 4 and the second deflection roller 6, arranged at a distance above it, are both mounted free-wheeling on a support 8. The support 8 is positioned such that it can move vertically up and down between an upper position and a lower position. The support 8 is shown in FIG. 1 in the upper position and in FIG. 2 in the lower position. An operating mechanism 10 is provided for moving the support 8 between the lower and the upper position, for example with the aid of a pneumatic or an electric drive.

The lower feed belt 12 in the feed-in region I has an end adjacent to the discharge region II that is deflected by a deflection roller 14. The deflection roller 14 is positioned swiveling on the exposed end of a lever 16, wherein the lever 16 is positioned so as to pivot around an axis 17. In the illustrated embodiment, a downward pointing extension 18 is rigidly attached to the swivel lever 16, but is connected articulated to a second operating mechanism 20. The second operating mechanism 20, for example provided with a pneumatic or electric drive, causes the lever 16 to swivel and the deflection roller 14 for the feed belt 12 to move between an upper and a lower position. In FIG. 1, the swivel lever 16 is shown in the upper position and in FIG. 2 in its lower position. The swiveling movement is delimited on one side by a first end stop 22 that defines the lower position of the swivel lever 16 and thus the deflection roller 14 and on the other side by a second end stop 23, which defines the upper position of the swivel lever 16 and thus the position of the deflection roller 14.

The discharge region II is provided with a discharge belt 24, which is deflected at the beginning of its upper belt section 24*a* that is adjacent to the feed-in region I by a deflection roller 26 in conveying direction A.

Figure 2:
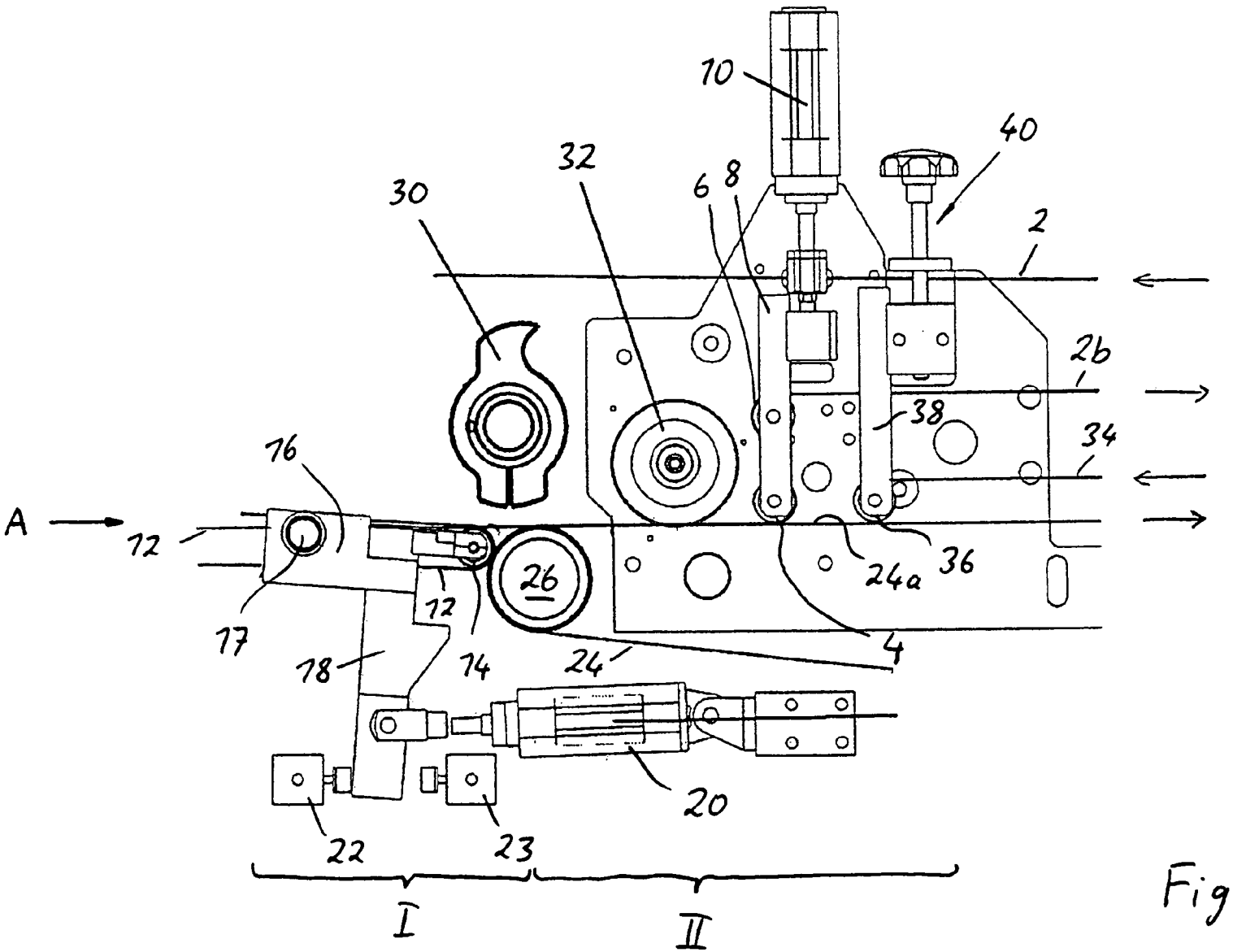
FIG. 2 is a schematic view from the side of the embodiment shown in FIG. 1, depicting a second operating state for the non-overlapping operation.

FIG. 1 shows that the upper belt section of the lower feed belt 12 is positioned above the upper belt section 24*a* of the discharge belt 24 with the swivel lever 16 being in its upper position. In this way, an overlap stage 28 is formed between the upper belt section of the lower feed belt 12 and the upper belt section 24*a* of the lower discharge belt 24 and thus at the transition between the feed-in region I and the discharge region II. This overlap stage, however, disappears if the swivel lever 16 is swiveled to the lower position, as shown in FIG. 2. In that case, the end of the upper belt section of the lower feed belt 12, which is adjacent to the discharge region II, is located approximately at the same height as the upper belt section 24*a* of the lower discharge belt 24.

In this embodiment there is provided an overlap finger 30 at the beginning of the discharge region II, above the deflection roller 26, which is positioned so as to rotate. Downstream of the overlap finger 30, a braking roll 32 is mounted to rotate above the upper belt section 24*a* of the lower discharge belt 24.

Finally, the discharge region II of this embodiment is provided with an upper discharge belt 34, which is arranged downstream of the support 8 and below the raised belt section 2*b* of the joint upper belt 2 that is deflected by the second deflection roller 6. The beginning section of the upper discharge belt 34 is deflected by a deflection roller 36 that is positioned to rotate on a support 38. The support 38 is mounted displaceable in the vertical direction and is activated for a height adjustment by a third operating mechanism 40. As shown in the Figures, the third operating mechanism 40 can either be operated manually, with an adjustment screw, or alternatively also with a motorized drive, e.g. an electric motor, or pneumatically.

The belts 2, 12, 24, and 34, and the overlap finger 30 and the braking roll 32, are each operated by individual drives that are not shown herein. Also provided is a control unit, not shown herein, which activates the individual drives for the belts 2, 12, 24 and 34, the overlap finger 30, and the braking roll 32, as well as the operating mechanisms 10 and 20. The control unit switches the device between an overlapping operation in a first operating state and a non-overlapping operation in a second operating state and/or optionally adjusts it to one of the two operating states.

For the overlapping operation of the device in the first operating state, as shown in FIG. 1, the control unit activates the drives for the belts 2, 12, 24 and 34, such that the joint upper belt 2 and the lower feed belt 12 are driven with a comparably high first speed and the lower discharge belt 24 and the upper discharge belt 34 are driven with a relatively low second speed. The first operating mechanism 10 is activated by the control unit so that the support 8 is in the upper position. As a result, the joint upper belt 2 with its lower belt section 2*a* is raised in the discharge region II, relative to the upper belt section 24*a* of the discharge belt 24 and thus also relative to the conveying plane, as shown in FIG. 1. The spacing in this case is such that the joint upper belt 2 is no longer in a position to influence the conveyed positioned of a sheet on the lower discharge belt 24 (not shown in the Figures). In other words, the joint upper belt 2 is deactivated in the discharge region II. In the feed-in region I, on the other hand, the lower belt section 2*a* of the joint upper belt 2 rests on the upper belt section of the lower feed belt 12, or forms only a narrow gap with this belt, so that the undersides of the successively fed-in sheets at this location rest on the lower feed belt 12 and the tops of the sheets make contact with the joint upper belt 2.

The second operating mechanism 20 is activated by the control unit to swivel the lever 16 and move it to the upper position. As a result, the previously mentioned overlap stage 28 is formed in the boundary area between the feed-in region I and the discharge region II, which can also be seen in FIG. 1. The control unit furthermore activates the drive for the overlap finger 30, such that the finger rotates in time with the sheet that is passing by. The drive for the braking roll 32 is activated by the control unit so that the rotational direction of the braking roll 32 corresponds to the movement direction of the upper belt section 24*a* of the lower discharge belt 24 and that the circumferential speed of the braking roll 32 approximately corresponds to the conveying speed of the upper belt section 24*a* of the lower discharge belt 24.

The sheets successively enter the feed-in region I and subsequently the discharge region II. Once they enter the discharge region II, the sheets are successively slowed down at the leading edge by the braking roll 32, meaning at the instant when the respective sheet moves with its trailing edge through the overlap stage 28. The movement of the overlap finger 30 in this case is timed such that it pushes down the trailing edge of the sheet that passes by to allow the leading edge of the following sheet to slide easily onto the trailing edge of the preceding sheet, thereby forming an overlap. In FIG. 1, the overlap finger 30 is shown in the position where it points downward for exerting pressure onto the trailing edge of a sheet.

An overlapping flow of sheets is thus generated in the discharge region II with the above-described device and by adjusting the individual components. This overlapping flow is generated without the influence of the fast-moving joint upper belt 2 since this belt has been raised up in the discharge region II. Further downstream, the overlapping flow positioned on the upper belt section 24*a* of the lower discharge belt 24 is gripped on the top by the lower belt section of the upper discharge belt 34 and is conveyed away.

The third operating mechanism 40 functions to adjust the pressure exerted by the lower belt section of the upper discharge belt 34 onto the upper belt section 24*a* of the lower discharge belt 24. If the third operating mechanism 40 is alternatively provided with a motorized drive, this drive can also be activated accordingly by the control unit.

In contrast, FIG. 2 shows a non-overlapping operation in the second operating state, for which the control unit activates the individual drives for the belts 2, 12, 24 and 34 so that all belts operate with the same and preferably relatively high speed, thus resulting in an essentially synchronous operation. The same is true for the braking roll 32, which insofar loses its effect. Since the overlap finger 30 is no longer needed in this operating state, its drive is disconnected by the control unit, so that the overlap finger 30 no longer rotates and/or is prevented from executing a further rotation, and is thus stopped. For this, the overlap finger 30 is preferably 'parked' in a position where it points upward, as shown in FIG. 2. Furthermore, the first operating mechanism 10 is activated such that the support 8 is moved to the lower position. As a result, the lower belt section 2*a* of the joint upper belt 2 in the discharge region II rests on the upper belt section 24*a* of the lower discharge belt 24 or is positioned so as to form only a narrow gap with this belt. As a result, the sheets positioned on the upper belt section 24*a* of the discharge belt 24 simultaneously also make contact with the lower belt section 2*a* of the joint upper belt 2. The control unit furthermore activates the second operating mechanism 20 so that the swivel lever 16 is moved to its lower position. The lower feed belt 12 is thus positioned with the end of its upper belt section in the region of deflection roller 14, approximately at the height of the upper belt section 24*a* of the discharge belt 24, thereby causing the overlap stage 28 from FIG. 1 to disappear. Finally, in this operating state the spacing between the lower belt section of the upper discharge belt 34 and the upper belt section 24*a* of the lower discharge belt 24 can be adjusted with the aid of the third operating mechanism 40 to match the thickness of the sheets to be conveyed. With this configuration and adjustment of the device, individual sheets can now be conveyed successively and preferably with relatively high speed.

It follows from the above text that the joint upper belt 2 is driven with the same high speed in both operating states, thus making it unnecessary for the control unit to switch to different speeds.

Finally and for the sake of completeness, the device shown in the Figures is described in the above text in connection with the processing of sheets and/or paper sheets. However, the device in principle can be used for the processing and/or conveying of any type of flat items, preferably items made of a flexible material.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for conveying sheet-type, flat items, comprising:

a lower feed-in conveyor in a feed-in region to convey and successively feed in the flat items in a conveying direction, a lower discharge conveyor in a discharge region, following the feed-in region in the conveying direction, and having an upper belt section to convey and discharge the flat items;

a joint upper belt conveyor extending across the feed-in region and the discharge region and having a lower belt section which is positioned above the lower feed-in conveyor such that a top of a flat item positioned on the lower feed-in conveyor comes in contact with the joint upper belt conveyor;

an overlap device to generate an overlapping flow of flat items in the discharge region;

a control unit for switching the apparatus between first and second operating states, wherein the control unit activates the overlap device in the first operating state and deactivates the overlap device in the second operating state; and a first operating mechanism connected to the control unit and operative to move the lower belt section of the joint upper belt conveyor that faces the lower discharge conveyor between (i) a first position in the first operating state to form a gap between the lower belt section of the joint upper belt conveyor and the upper belt section of the lower discharge conveyor to prevent the joint upper belt conveyor from making contact with the flat items positioned on the lower discharge conveyor, and (ii) a second position in the second operating state to form a gap between the lower belt section of the joint upper belt conveyor and the upper belt section of the lower discharge conveyor, so that only a single flat item can respectively be introduced between the lower discharge conveyor and the joint upper belt conveyor, wherein the underside of the flat item rests on the lower discharge conveyor and the top makes contact with the joint upper belt conveyor.

2. The apparatus according to claim 1, wherein the lower feed-in conveyor has an upper belt section, and the apparatus further includes a second operating mechanism connected to the control unit to switch one of an end of the upper belt section of the lower feed conveyor adjacent to the discharge region that carries the flat items or a beginning of the upper belt section of the lower discharge conveyor that is adjacent to the feed-in region between a first position in the first operating state in which the end of the upper belt section of the lower feed conveyor is positioned above the beginning of the upper belt section of the lower discharge conveyor that is adjacent to the feed-in region to form an overlap stage, and a second position in the second operating state in which the end of the upper belt section of the lower feed conveyor that is positioned adjacent to the discharge region is essentially at the same level as the beginning of the upper belt section of the lower discharge conveyor which is adjacent to the feed-in region.

3. The apparatus according to claim 2, further including a deflection device to deflect the end of upper belt section of the lower feed-in conveyor, the deflection device being coupled to the second operating mechanism, wherein the second operating mechanism is operative to switch the deflection device between the first and second positions of the end of the upper section of the lower feed-in conveyor.

4. The apparatus according to claim 3, wherein the lower feed-in conveyor includes swivel lever on which the deflection device is arranged and which can be swiveled by the second operating mechanism.

5. The apparatus according to claim 1, further comprising a first deflection device disposed in the discharge region to deflect the lower belt section of the joint upper belt conveyor away from the lower discharge conveyor so that a belt section of the joint upper belt conveyor which leaves the first deflection device is thereafter out of contact with the flat items positioned on the lower discharge conveyor, wherein the first operating mechanism is coupled to the first deflection device and is operative to switch the first deflection device between an upper position and a lower position, corresponding to the first position and the second position of the lower belt section of the joint upper belt conveyor, respectively.

6. The apparatus according to claim 5, further comprising a support on which the first deflection device is mounted, and a second deflection device mounted on the support to deflect again the belt section of the joint upper belt conveyor that is deflected by the first deflection device approximately in the conveying direction and at a distance to the lower discharge conveyor, wherein the support is positioned to be moved between a lower position and an upper position and wherein the first operating mechanism activates the support to move between the lower position and the upper position.

7. The apparatus according to claim 5, further comprising an upper discharge conveyor having a lower belt section and being arranged above the lower discharge conveyor; and a third operating mechanism to adjust the distance between the lower belt section of the upper discharge conveyor and the upper belt section of the lower discharge conveyor.

8. The apparatus according to claim 7, further comprising an additional deflection device that deflects a beginning of the lower belt section of the upper discharge conveyor; wherein the third operating mechanism is coupled to the deflection device to trigger an adjustment of a distance of the additional deflection device to the upper belt section of the lower discharge conveyor.

9. The apparatus according to claim 7, wherein the upper discharge conveyor is positioned downstream of the first deflection device that deflects the lower belt section of the joint upper belt conveyor.

10. The apparatus according to at claim 1, wherein the overlap device comprises at least one overlap finger, rotatingly positioned, and arranged in the discharge region adjacent to the feed-in region, the overlap finger being driven to rotate in time with arriving flat items, such that the overlap finger pushes down a trailing edge of a flat item that moves past.

11. The apparatus according to claim 10, wherein the control unit in the second operating state moves the overlap finger away from the flat items to maintain a position out of contact with the flat items.

12. The apparatus according to claim 1, and further including driving devices connected to the conveyors and controlled by the control unit such that in the first operating state, the driving devices are controlled so that the joint upper belt conveyor and the lower feed conveyor are respectively driven with a first speed and that conveyors in the discharge region are driven with a second speed, which is slower than the first speed, and in the second operating state all belt conveyors are controlled to operate essentially at the same speed.

13. The apparatus according to claim 12, further comprising:

at least one braking roll, positioned rotating in the discharge region, downstream of the overlap device, wherein the braking roll is arranged above the upper belt section of the lower discharge conveyor so that tops of the flat items positioned on the lower discharge conveyor come in contact with the braking roll; and a drive for the at least one braking roll, wherein the control unit is connected to and controls the drive for the at least one braking roll so that in the first operating state and in the second operating state the at least one braking roll rotates approximately synchronous with the lower discharge conveyor.

* * * * *